United States Patent [19]

Miyake et al.

[11] 4,205,622

[45] Jun. 3, 1980

[54] ELECTROPHOTOGRAPHIC DEVELOPING APPARATUS HAVING DEVELOPER AND REFRESHING ROLLERS FOR LIQUID DEVELOPERS

[75] Inventors: Hiroyuki Miyake, Inagi; Hiroshi Ogawa, Kawasaki; Hirotoshi Kishi, Tokyo; Kazumi Umezawa; Seiji Sagara, both of Kawasaki; Hiroshi Hara, Tokyo, all of Japan

[73] Assignee: Canon Kabushiki Kaisha, Tokyo, Japan

[21] Appl. No.: 938,102

[22] Filed: Aug. 30, 1978

[30] Foreign Application Priority Data

Sep. 14, 1977 [JP] Japan ..... 52/110939

[51] Int. Cl.[2] ..... G03G 15/10

[52] U.S. Cl. ..... 118/661; 134/6; 355/10; 101/376; 118/249

[58] Field of Search ..... 118/661, 247, 248, 249; 355/10; 134/6; 101/349, 376

[56] References Cited

U.S. PATENT DOCUMENTS

| | | | |
|---|---|---|---|
| 2,913,353 | 11/1959 | Mayer et al. | 118/661 |
| 4,042,415 | 8/1977 | Hwa | 134/6 |

*Primary Examiner*—John D. Welsh

*Attorney, Agent, or Firm*—Fitzpatrick, Cella, Harper & Scinto

[57] ABSTRACT

An electrophotographic developing apparatus comprises a developing roller and a refreshing roller. The developing roller applies liquid developer to an electrostatic latent image carrier moving in a predetermined direction. The refreshing roller comes into contact with the developing roller and rotates at the same peripheral speed as that of the carrier and in the opposite direction to the moving direction of the carrier. The rotational motion of the refreshing roller causes the developing roller to rotate so as to effect developing the electrostatic latent image on the carrier.

14 Claims, 11 Drawing Figures

ELECTROPHOTOGRAPHIC DEVELOPING APPARATUS HAVING DEVELOPER AND REFRESHING ROLLERS FOR LIQUID DEVELOPERS

BACKGROUND OF THE INVENTION

1. Field of the Invention

The present invention relates to a developing apparatus in an electrophotographic apparatus and more particularly relates to a developing apparatus used in such type of electrophotographic apparatus in which developing is carried out with liquid developer.

2. Description of the Prior Art

Wet roller developing process is known in the art. For example, such wet roller developing apparatus is known from U.S. Pat. No. 4,042,415 which comprises a supply roller with its lower portion being dipped into liquid developer contained in a reservoir and an upper roller having a helical groove formed on the circumferential surface thereof. The supply roller takes up the liquid developer from the reservoir and transmits it to the upper roller which supplies the liquid developer to a surface to be developed. Residual liquid developer in the helical groove of the upper roller is removed by a doctor blade disposed in contact with the upper roller.

Also, as an improved type of roller used for the above mentioned wet roller developing process there is known from Japanese Patent Application Publication No. 14,071/1966 published on Aug. 5, 1966 such developing roller which comprises a cylindrical core member, a sponge layer laid on the core member and a wire net covering the sponge layer. The core member is made of metal or insulating material and rotatably mounted on a rotary shaft. The sponge layer is made, for example, of polyurethane foam material and the wire net is of a certain predetermined mesh number.

SUMMARY OF THE INVENTION

It is the object of the present invention to further improve the wet roller developing apparatus of the prior art as mentioned above.

In particular, the subject of the present invention is a further development of the invention disclosed in Japanese Patent Application laid open No. 40,336/1977 of the same assignee as of the present application.

According to the present invention, there is provided an electrophotographic developing apparatus comprising a developing roller for supplying liquid developer to an electrostatic latent image carrier and a refreshing roller being able to come into contact with the developing roller and rotate at the same peripheral speed as the moving speed of the carrier and in the opposite direction to the moving direction of the carrier, said developing roller being driven into rotation by the rotation of the refreshing roller so as to effect developing the electrostatic latent image on the carrier.

The apparatus according to the invention is novel to all the prior art apparatus as mentioned above and can be used advantageously to carry out a wet roller developing process which is now replacing the conventional wet cascade developing process.

The developing apparatus according to the invention has the following advantages:

1. It is very suitable for a high speed copy making operation.

2. It is a space saving type of developing apparatus as compared with the conventional cascade developing apparatus.

3. A substantial reduction in consumption of liquid developer is attainable with it because it allows a drastic squeezing of liquid developer.

4. It enables production of a sharp and clear image without fogging.

5. The surface area of liquid developer exposed to the atmosphere can be reduced to the extent that the evaporation of liquid developer may be minimized.

6. It is simple in structure and reliable in operation so that production of images of high quality and high stability can be assured for a long time.

In addition to the above mentioned advantages, the developing apparatus according to the invention has an improved durability. The copying apparatus in which the present invention is embodied has no need of particular maintenance and even after leaving it standing for a long time the apparatus is able to start a copying operation at once.

Other and further objects, features and advantages of the invention will appear more fully from the following description taken in connection with the accompanying drawings.

DESCRIPTION OF THE PREFERRED EMBODIMENTS

Figure 1:
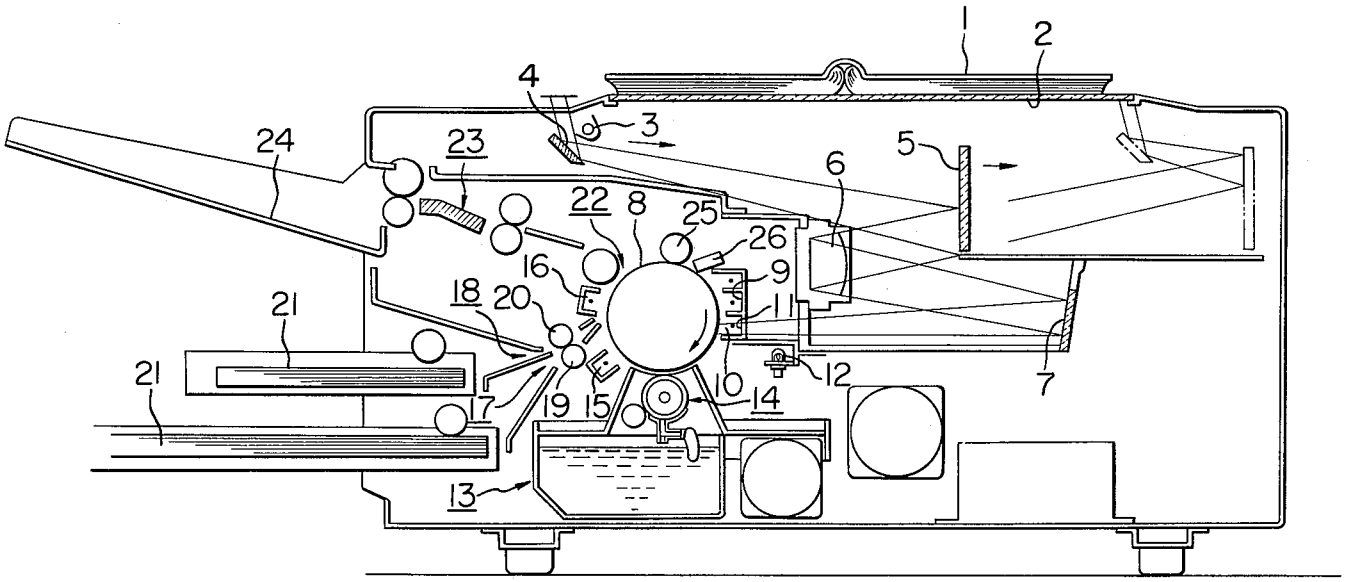
FIG. 1 shows a copying apparatus including an embodiment of the developing apparatus according to the invention.

Referring first to FIG. 1 there is shown a preferable example of electrophotographic copying apparatus in which a developing apparatus of the present invention is provided. Designated by 1 is an original to be copied which is placed on an original table 2. The image of original is imaged on a drum 8 by an optical system composed of illumination lamp 3, first and second mirrors 4 and 5, inmirror lens 6 and mirror 7. The illumination lamp 3 and the first mirror 4 are moved together in the direction indicated by the arrow and the second mirror 5 is moved in the same direction but at a speed equal to half ofthe speed of the first one 4. The lens 6 and mirror 7 are stationary. The surface of the drum 8 is formed as photosensitive surface layer on which a latent image can be formed employing any of the latent image forming processes known per se. For example, the photosensitive drum surface is uniformly charged by a primary charger 9 and then at the imaging station 10 it is imagewise exposed in a manner as described above while being discharged by a discharging device 11 simultaneously. Thereafter, the whole surface of the drum is exposed to light of a whole surface exposure lamp 12 so that an electrostatic latent image may be formed on the drum surface.

The latent image thus formed on the drum surface is developed by a developing roller 14 in a developing apparatus 13 with liquid developer. As to the developing apparatus 13 and the developing roller 14 disposed therein, a detailed description will be made hereinafter.

The latent image on the drum is generally visualized with toner contained in the liquid developer. In order to assist in adsorption of toner on the drum surface, there is provided a post charger 15 which charges the drum surface with electric charge resulted from a weak corona discharge which takes place immediately after developing. The developed image is then transferred onto a sheet of copy paper 21 under the action of a transferring charger 16. The transfer sheet 21 is fed from a sheet feeding part 17 or 18 with its fore edge being registered with the fore edge of the developed image on the drum by a pair of register rollers 19 and 20. The copy paper 21 having thereon the developed image is separated from the drum at the separation station 22 and then introduced into the fixing station 23 where the developed image is fixed. After fixing, the copy sheet 21 is discharged into a tray 24. On the other hand, the drum surface is preliminarily cleaned by a cleaning roller 25 rotating in the opposite direction to the rotation of the drum while keeping itself in pressure contact with the drum surface. After being subjected to a complete cleaning action of a cleaning blade 26, the photosensitive drum is ready for the next cycle of copying operation.

Figure 2:
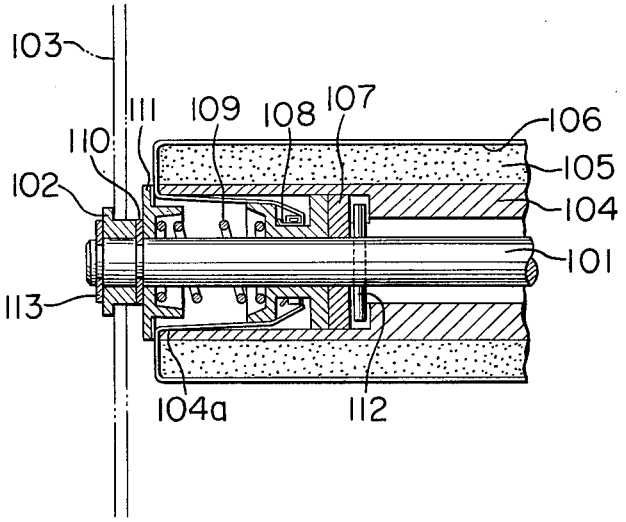
FIG. 2 is a partial cross section of the developing roller shown in FIG. 1.

The structure of the developing roller 14 is shown in FIG. 2. While only one end portion of the developing roller is seen in FIG. 2, the developing roller has the same structure at the other end portion and has a roller length enough to cover the width of image formed in the copying machine.

Designated by 101 is a shaft made of electrically conductive material and rotatably supported at the both ends of the shaft by bearings 102 and 131 (131 not shown). Each bearing is made of electrically non-conductive material and mounted on a side plate 103 as suggested by the phantom line. 104 designates a roller core of electrically conductive material on which a layer of spongy foam material 105 is laid. The foam layer 105 has an open cell structure and a net 106 is overlaid on it so as to cover the circumferential surface of the foam layer 105. Electrically conductive material or non-conductive material may be used to form the foam layer 105 alternatively. When conductive material such as conductive urethane, foam material is used for the layer 105, the net 106 is made of electrically non-conductive material such as nylon gauze. On the contrary, if the foam layer is of electrically non-conductive material such as NBR (nitrile butadiene rubber), then the foam layer is covered with a net of electrically conductive material 106 such as wire gauze or nylon gauze plated with metal. For either case of combination, a good result can be obtained by using a net 106 of mesh size ranging from 200 to 250.

As the developing roller is constructed in the above described manner, the roller comes into engagement with the drum during developing in a fashion of slight pressure contact and the rotation of the drum accompanies a rotation of the developing roller 14 through friction between the developing roller and the drum. The contacting pressure applied to the developing roller by the drum during developing varies depending upon the diameters of the developing roller and drum. By way of example, it may be shown that in case that the drum diameter=136 mm and the developing roller diameter=40 mm, the contacting pressure preferably used is such that makes the developing roller diameter compressed by some 0.5 to 1 mm. As described hereinafter, the developing roller is pressure contacted further by a refreshing roller. Due to the friction existing between the developing roller and the drum as well as between the developing roller and the refreshing roller, there may be formed creases in the above mentioned net 106 or crease already formed at the time of assembly may be developed over the area of the net gradually with the rotation of the developing roller. To prevent such trouble, the net 106 is folded back at both its ends and fastened to a holder member 107 by the aid of the band 108 and the like. The holding member 107 is spring biased toward the middle portion of the roller by a helical spring 109 which is seated at its another end on a spring seat 111. The holder member 107 is slideable on and along the shaft 101 without play and furthermore a portion of the holder member is slidable together with the roller core 104 without any play. Therefore, the net 106 is always subjected to the tension at its both ends by the spring 109 so that forming of crease in the net during developing and/or expanding of crease from edge portion to the central portion may be prevented. A connecting pin 112 assures the rotation of the roller core 104 together with the shaft 101. A fastening member 113 prevents the bearing 102 from drawing out from the side plate 103.

During developing, the foam layer 105 impregnated with liquid developer is compressed as a result of pressure contact of the developing roller with the drum and the liquid developer is squeezed from the foam layer onto the drum surface so that developing the latent image on the drum surface is effected. When the foam layer is released from the contacting pressure, the residual liquid developer remained on the drum is again absorbed up into the foam layer. As already mentioned above and as will be seen from FIG. 1, this developing process using the developing roller has various advantages as compared with the conventional cascade developing process. Developing can be effected in a much smaller area of the drum surface compared with the case of the cascade developing process. A very effective squeezing of liquid developer is assured. As described hereinafter, the developing roller has an electrode on its surface or in the vicinity of the surface. Therefore, available effect of electrode becomes large enough to accommodate the apparatus for a high speed development. Moreover, as will be understood from FIG. 1, the developing apparatus 13 has a relatively high airtightness and therefore evaporation of liquid developer from the developing apparatus is reduced to a minimum. These features and advantages of the developing apparatus are described in the beforementioned Japanese Patent laid open No. 40,336/1977 and need not be further described herein.

In order to increase the contrast of developed image on the drum and/or in order to eliminate fogging, there is often employed in the art such technique according to which a bias voltage is applied to the developing roller or the bias is grounded if necessary the bias voltage is switched over from one level to another. In the shown embodiment of the invention, this can be done by contacting a bias electrode not shown to the end portion of the shaft 101. Since, as previously noted, the both ends of the shaft 101 are supported by an electrically insulating bearing 102, a suitable bias can be applied only to the developing roller without giving any effect on other portions of the apparatus. When the net is of insulating material and the foam layer is of conductive material, the bias voltage applied is transmitted to the roller core 104 through the shaft 101 and the connecting pin 112. Since the core 104 and foam layer 105 are bonded together with an electrically conductive bonding agent, the bias voltage is finally applied to the foam layer 105. On the contrary, when the net is electrically conductive material and the foam layer is of insulating material, the bias voltage is finally applied to the net 106 because of the contact between the net and core at the end portion 104*a* of the roller core 104. In this manner, the developing roller 14 is able to have an electrode to which a bias voltage is applied, on its surface or in the area very close to the surface. During developing, the electrode comes into contact with the drum surface directly or even when it does not contact with the drum surface, the electrode can come up close to the drum surface. This brings forth a remarkable effect for eliminating fog from the visualized image on the drum. Also, when the contrast of original is weak, the nearness of the electrode to the drum surface enables production of a visualized image of high contrast from such original by applying a bias to the electrode in a simple manner.

Referring now FIGS. 3–8, the developing apparatus according to the invention is described in detail.

Figure 3:
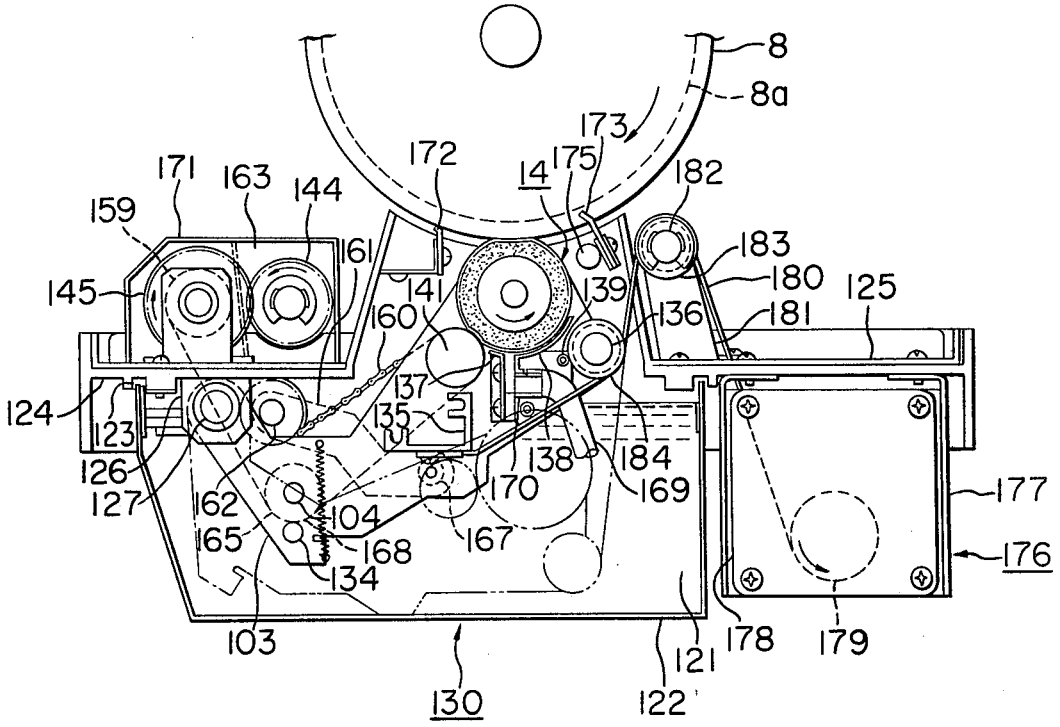
FIG. 3 is a detailed view of an embodiment of a developing apparatus according to the invention.

In FIG. 3, the reference numeral 122 designates a container containing liquid developer 121. The container 122 is connected with an upper plate 124 and a reinforce plate 125 through a rubber packing 123 in a manner that the container is closed almost hermetically to limit the evaporation of liquid developer to a minumum. The reinforce plate 125 is provided to reinforce the upper plate. To the reinforce plate 125 there is fixed a supporting plate 126 having a pivot 127. While not seen in FIG. 3, at the other side of the reinforce plate 125, there is provided also a supporting plate 128 having a pivot 129 secured thereto the arrangement of which corresponds to that of the above mentioned supporting plate 126 having the pivot 127.

The developing roller 14 is supported by a pair of side plates 103, 130 (only side plate 103 is shown in FIG. 3; see the side plate 130 shown in FIG. 7) by means of a pair of bearings 102, 131 (102 only is seen in FIG. 2). Two side plates 103 and 130 are essentially same in shape excepting a minor difference. Side plates 103, 130 are mounted pivotally movably about the pivots 127, 129 through bearings 132, 133 (133 is not shown). In order to allow the two side plates 103 and 130 to swing about the pivots 127, 129 as a unit, stays 134, 135 and 136 connect the two side plates together. Under the developing roller 14 there are disposed two electrodes 137 and 138 with a small gap (1 -2 mm) between the electrode and the outer surface of the roller. These electrodes are electrically spaced from the side plates to which they are fixed, by insulating blocks 139 and 140 (140 is not shown) respectively. Between the two side plates 103 and 130, a refreshing roller 141 is mounted rotatably by means of bearings 142 and 143 (neither of the bearings are shown).

In FIG. 3, the developing apparatus is shown in the operating state. The manner of operation of the developing apparatus 13 is as follows:

The photosensitive drum 8 rotates in the direction of arrow. Two gears 144 and 145 in mesh with each other rotate in the direction indicated by arrows on the developing apparatus. As seen best in FIG. 4, gear 144 is secured on a shaft 146 rotatably supported by a bearing 147. The bearing 147 is mounted on a housing 148 fixed on a side plate 149 of the main body of the apparatus. Another gear 145 is secured on a shaft 153 which is in turn supported by a bearing 150 at its one end and by a bearing 152 at the other end. The bearing 150 is mounted between the above described housing 148 and the side plate 149 whereas the bearing 152 is mounted on a supporting plate 151 fixed to the above described reinforce plate 125.

Figure 4:
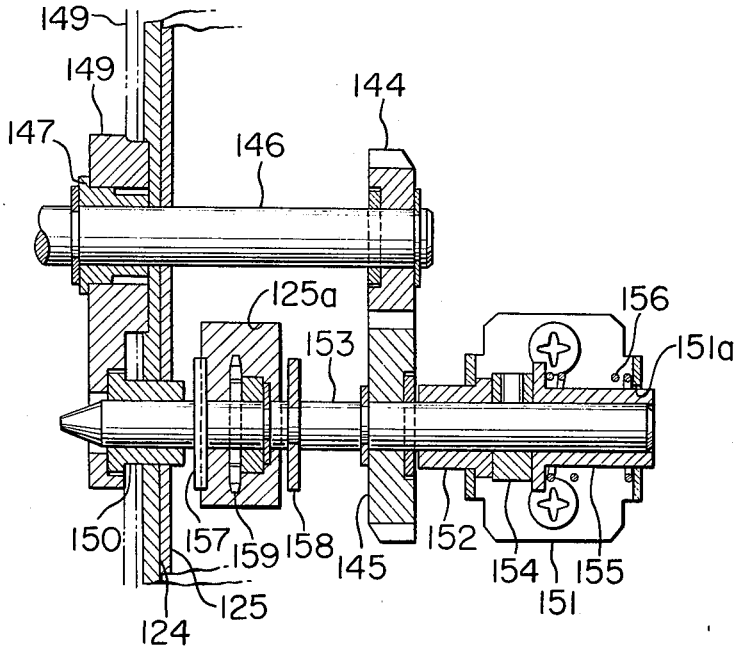
FIG. 4 is a sectional view of the driving mechanism for the developing apparatus shown in FIG. 3.

On the shaft 153 there is also mounted firmly a stopper 154 at the right hand side of the bearing 152 as viewed on the the drawing of FIG. 4. At the right hand side of the stopper on the shaft 153 there is also mounted a spring seat 155 in such manner that one end of the spring seat can loosely enter an opening 151*a* provided in the supporting plate 151. A compression spring 156 is disposed between the spring seat 155 and supporting plate 151 so as to allow the shaft 153 to move axially. A chain sprocket 159 is further mounted on the shaft 153 firmly with draining rubbers 157 and 158 disposed on either side of the sprocket. A chain 160 (see FIG. 3) extends around the sprocket 159 to transmit a driving power from the gear 144 to the refreshing roller 141. The chain 160 passes through the opening 125*a* provided in the reinforce plate 125. The movement of the chain 160 will be described hereinafter. The shaft 146 is driven into rotation by driving power transmitted to the left side portion (relative to the side plate 149) of the shaft from a driving part for drum 8 through a suitable transmission means comprising, for example, gear train, chain and belt. The rotation of the shaft 146 is transmitted to the sprocket 159 through the gears 144, 145 and the shaft 153. Gear ratio, sprocket gear ratio and other transmission conditions are so selected as to make the peripheral speed of the refreshing roller equal to that of the drum.

It is desirable that developing apparatus can be removably set in the body of the related copying machine. In case of the shown embodiment of the developing apparatus of the invention, the developing apparatus can be removed from the body of the related copying machine by moving it toward you as viewed in the drawing of FIG. 3. When the developing machine is inserted again into the machine body, there may arise a difficulty in bringing the gear 145 into mesh with the gear 144 correctly because of the interference of tooth crests of the two gears with each other. In such case, according to the shown embodiment, the spring 156 is compressed to allow the shaft 153 to move rightward (relief shift). Since the gear 145 is always under the spring force, it can instantly come into mesh with the gear 144 upon the time when the latter is driven and it gets in a position to transmit the driving power from the driving source part to the refreshing roller 141. The above mentioned drain rubbers 157 and 158 serve to prevent liquid developer taken up by the chain 160 from coming into the machine body or into the bearings 150, 152 through the shaft 153, which may otherwise make dirty the inner parts of the machine or give an adverse effect on the function of the bearings.

The sprocket 159 rotates in the direction indicated by an arrow in FIG. 3. The endless chain 160 moves passing around the sprockets 159, 163, 165 and 166 to transmit the driving power from the gear 144 to the refreshing roller 141. The sprocket 163 is mounted on a shaft 162 fixed to a tensioner 161 and the sprocket 165 is mounted on a shaft 164 fixed on the side plate 103. While not seen in FIG. 3, the sprocket 166 is operatively connected with the refreshing roller 141. To apply an optimum tension to the chain 160, the tensioner 161 is mounted pivotally about a pivot 167 secured on the side plate 103. Moreover, between the tensioner 161 and the side plate 103 there is disposed a tension spring 168 to give a tension always to the chain 160.

During the operation of developing, the developing roller 14 is sandwiched between the drum 8 and the refreshing roller 141 and it is subjected to the contacting pressure by both of the drum refreshing roller. Therefore, at this stage of operation, the developing roller 14 is somewhat deformed by compression. Since the developing roller is disposed between the side plates 103 and 130 rotatably through the bearings 102 and 131, it is driven into rotation in the direction of arrow by the friction existing between the drum and the developing roller as well as between the refreshing roller and the developing roller. In this manner, developing is effected.

Since, as previously noted, the refreshing roller 141 is rotated at the same peripheral speed as that of the drum 8, the developing roller is also rotated by them at the same speed. Therefore, the net on the surface of developing roller never becomes creased. The function of the refreshing roller 141 is to squeeze out the used old developer liquid from the developing roller immediately after developing and to impregnate the foam layer of the developing roller with fresh liquid developer pumped up through pumping means (not shown). The fresh liquid developer pumped up through pumping means enters the space between the electrodes 137 and 138 through a tube 169 and a pipe 170 and then it moves upward up to the developing roller 14. When freed from the pressure contact with the refreshing roller 141, the developing roller can absorb the fresh liquid developer into its spongy foam layer and it becomes ready for the next developing operation. If it is required to further accelerate the absorption of fresh liquid developer by the developing roller, then a bias voltage of the opposite polarity to that of the toner may be applied to the electrodes 137 and 138.

The chain 160 passes through in the liquid developer within the container and accompanies some amount of liquid developer in its course of movement. However, as seen in FIG. 3, the area around the sprocket 159 is almost hermetically closed with a cover 171 so as to prevent evaporation of liquid and also to prevent the accompanied toner from being dried and solidified on the chain 160. The cover 171 also encloses the gears 144 and 145 with it to prevent the gears from being made dirty by toner.

At the left hand side of the developing roller 14 as viewed in FIG. 3, there is provided a scraper 172 in pressure contact with the edge portion of the drum 8. A similar scraper is provided also at the other side edge portion of the drum. These scrapers scrape off unnecessary toner adhered onto the area of drum outside of image area and prevent such toner from entering the transferring station. At the right side of the developing toner 14 as viewed in FIG. 3 and the positions corresponding to the edge slots **8*a*, 8*b* (8*b* is not seen) of the drum, there are also provided slot cleaning rubber members 173, 174 (174 is not seen in FIG. 3). These slot cleaning rubber members 173, 174 serve to prevent the toner scraped by the cleaning blade 26 shown in FIG. 1 and guided by the edge slots 8*a*, 8*b* from reaching the developing roller 14 and making it dirty. Such toner scraped by the cleaning blade and guided by the edge slots is recovered within the developing apparatus before such toner approaches the developing roller by the action of the slot cleaning rubber members 173, 174. Each slot cleaning member is fixed to a shaft 175 rotatably mounted on the upper plate 124 at its both ends. When the developing apparatus is removed from or inserted into the machine body, the shaft 175 is rotated counterclockwise to disengage the slot cleaning rubber member 173, 174 from the edges slots 8*a*, 8*b***.

As described above, the developing roller according to the invention is positioned between the drum and the refreshing roller in a fashion of a wedge and is driven by the frictional force then produced. This driving method of developing roller has the following advantages:

1. The pressure applied to the developing roller is determined solely by the pressure contacts with the drum and with the refreshing roller. Therefore, adverse effect on image caused by the variation in diameter of the developing roller along the length of the developing roller is reduced to a minimum.

2. The developing roller is a driven roller and is connected with no gear or other transmission mechanism to positively drive the roller. Therefore, entrance of liquid developer into the drum gear and/or other part is prevented which otherwise makes the interior of the machine dirty.

3. Since the developing roller is in pressure contact with both of the drum and the refereshing roller, the developing roller can be driven solely by the frictional forces resulted from these contacts.

4. As described hereinafter, the degree of pressure contact with the drum (or contacting pressure applied to the developing roller by the drum) and the degree of pressure contact of the developing roller with the refreshing roller (or contacting pressure applied to the developing roller by the refreshing roller) can be selected optionally and very easily.

While the developing roller is in a state of pressure contact with the drum during the time when developing is carried out, it is desirable that the developing roller be released from the pressure contact with the drum at the time when no developing is carried out with it. More particularly, it is desired that during the rest time of developing operation, the developing apparatus be in a position in which it is completely immersed in liquid developer and free from any external pressure. The reasons are as follows:

1. When the developing roller is allowed to stand in the atmosphere, toner remaining in the foam layer thereof moves downward by gravity and thereby the density of toner in the foam layer becomes irregular which in turn may result in irregular development of image at the time of the next developing operation.

2. Leaving the developing roller standing in the atmosphere for a long time may cause such trouble that openings of the net and cells of the foam layer get clogged with solidified toners.

3. By leaving the developing roller standing in pressure contact with the drum and with the refreshing roller in the atmosphere for a long time, there is caused some permanent deformation in the developing roller due to solidified toner.

4. It is very troublesome and time-consuming that the pressure contact between the developing roller and the drum has to be released every time when the drum is mounted or removed.

For the reasons mentioned above, the developing apparatus according to the invention is provided with means for lifting and lowering the developing roller which is designated generally by 176 in FIG. 3 and hereinafter referred to also as developing roller shifting means. As seen in FIG. 3, said developing roller shifting means is arranged as an intergral part of the developing apparatus 13 and positioned at the right side of the apparatus 13. Basically, said developing roller shifting means 176 comprises a supporting plate 177 fixedly connected with the above mentioned upper plate 124 and reinforce plate 125, a motor 178 firmly mounted on the supporting plate, a pulley 179 connected with the output shaft of the motor and a wire cord 180 one end of which is secured to the pulley. Another end of the wire cord 180 is anchored to a stay 135 passing through intermediate pulleys 183 and 184. The pulley 183 is mounted rotatably about a shaft 182 fixed to a bracket 181 which is in turn mounted on the reinforce plate 125. The pulley 184 is rotatable about a stay 136.

As the motor 178 drives the pulley 179 into rotation in the direction of arrow, the latter winds up the wire cord 180 so as to lift the developing roller 14 in the position indicated by solid line. As the motor 178, a so-called torque motor (trade name) is preferably used. The use of a torque motor provides a developing roller lifting and lowering mechanism which is simple in structure and easy to assemble and has a high reliability.

Figure 5:
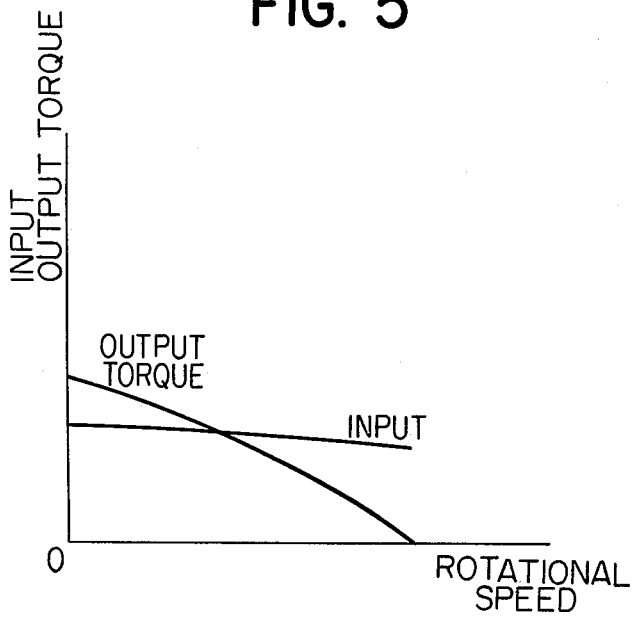
FIG. 5 shows an input-output curve of the torque motor used in the driving mechanism shown in FIG. 4.

FIG. 5 shows a typical input-output characteristic curve of such a torque motor. Change of input relative to rotational speed is very small, but change of output torque is very large. The maximum torque is obtained when rotational speed is zero, that is, when the motor stands still with voltage being applied to it. Therefore, when the developing roller 14 is moved towards the drum 8 in the above mentioned manner, the elevation of the developing roller 14 will continue until it comes into contact with the drum 8 and the contacting pressure applied to the developing roller by the drum and the rest torque of the torque motor 178 become balanced. After stopping the elevation, the motor keeps the developing roller in the position. Developing process is carried out in a manner as previously described under this equilibrium. When a developing operation has been completed, the motor 178 rotates in the reversed direction so that the wire cord is wound off from the pulley 179. As a result, the developing roller 14 begins moving downward by its own weight turning about the shafts 127, 129 and finally it takes the position suggested by chain-dotted line in FIG. 3. In the lowered position, the developing roller 14 is completely immersed in the liquid developer and not exposed to the atmosphere. Therefore, there never arise the problems mentioned above.

Figure 6A:
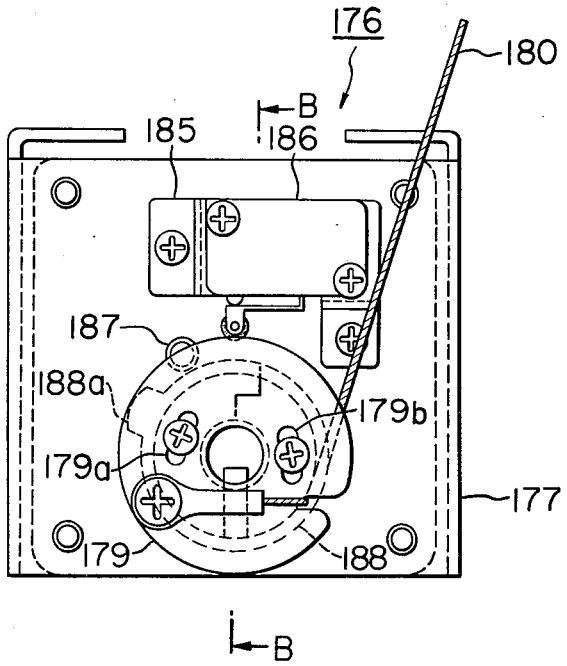
FIG. 6A is an elevation of the mechanism for lifting and lowering the developing roller shown in FIG. 3.
Figure 6B:
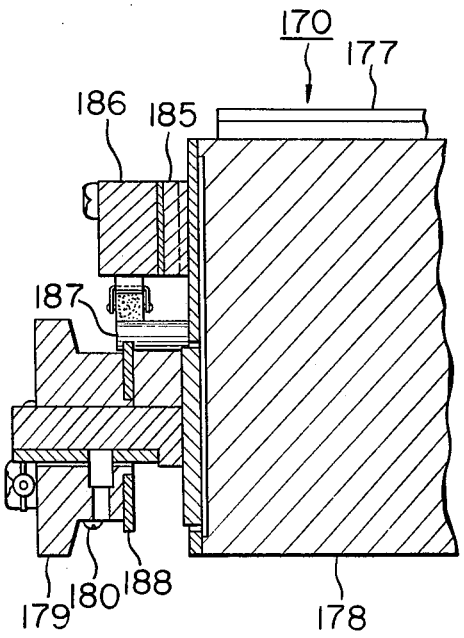
FIG. 6B is a sectional view thereof taken along the line B—B in FIG. 6A.

Developing roller lifting and lowering means 176 is described further in detail referring to FIGS. 6A and 6B.

One end of the wire cord 180 is secured on the front surface of the pulley 179 after being wound up around the pulley one or two turns. Above the pulley 179 there is mounted a microswitch 186 on the supporting plate 177 through a mounting plate 185. On the supporting plate 177 there is also fixed a stopper pin 187 in a position somewhat spaced from the microswitch leftward and downward as viewed in FIG. 6A. Closely fitted on a portion of the pulley 179 is a ring plate 188 having a projection **188*a* the function of which will be described hereinafter. As already described, when the wire cord 180 is wound up on the pulley 179, the developing roller is pulled up by the wire cord to come into contact with the drum. When the wire cord is wound off from the pulley, the developing roller 14 moves downward into the liquid developer. When the developing roller has been immersed completely in the liquid developer, the above mentioned projection 188*a* of the ring plate 188 pushes the contact of the microswitch 186 to stop the motor 178**. The developing roller is allowed to stand in the liquid developer.

In order to fixedly connect the pulley 179 and the ring plate 188 together, the pulley has two elongate slots **179*a* and 179*b* which are passed through by screw bolts respectively. These elongate slots also allow to adjust the position of the projection 188*a* serving as an actuator for the microswitch 186. By adjusting the position of the projection 188*a* it is assured that the developing roller 14 is lowered to the position in which it is completely immersed in the liquid developer. Since the position of the projection 188*a* can be adjusted in this manner whenever necessary, the length of wire cord 180 may have a relatively broad allowance at the time of manufacturing the parts. Even when the length of the wire cord is changed due to expansion and elongation during use, such change may be taken off by adjusting the position of the projection 188*a*** in a manner as mentioned above.

When exchange of developing roller is carried out, the pulley 179 is rotated by hand. In this case, the above mentioned stopper pin 187 cooperates with the projection **188*a* to stop the rotation of the pulley and to prevent any overshoot of the rotation. As will be seen from this fact, in the apparatus of the invention, the up-and-down movement of the developing roller is limited within a range of one rotation of the pulley 179**.

The use of a torque motor in the developing roller lifting and lowering mechanism brings forth various merits. Firstly, there is no need for worrying about accuracy of the length of wire cord 180. Secondly, the mechanism is simple in structure and is reliable. Lastly, only one microswitch is required for controlling the position of the developing roller.

Contacting pressure existing between the developing roller and the drum may be changed in a simple manner by changing either the capacity of the motor or the diameter of the pulley, provided that other factors remain unchanged. If there is no room sufficient to receive a larger motor, then the contacting pressure may be increased by using a winding pulley of a reduced diameter so as to apply a higher tension to the wire cord.

When developing is effected in the position of apparatus shown in FIG. 3, the torque motor 178 stands still but the application of voltage to the motor continues to keep the developing roller in pressure contact with the drum. During this time, a large quantity of heat is generated from the motor. To protect the liquid developer against such heat, the container 122 is spaced from the motor 178. Air layer in this space has the effect of thermally insulating the liquid developer within the container from the motor to some extent. To assure the thermal insulation, thermal insulating material may be used in place of an air layer within the space or a fan or the like may be used to directly cool the motor itself.

The relationship between the developing roller and the drum and between the developing roller and the refershing roller in respect to contacting pressure will be described with reference to FIGS. 7 and 8.

Figure 7:
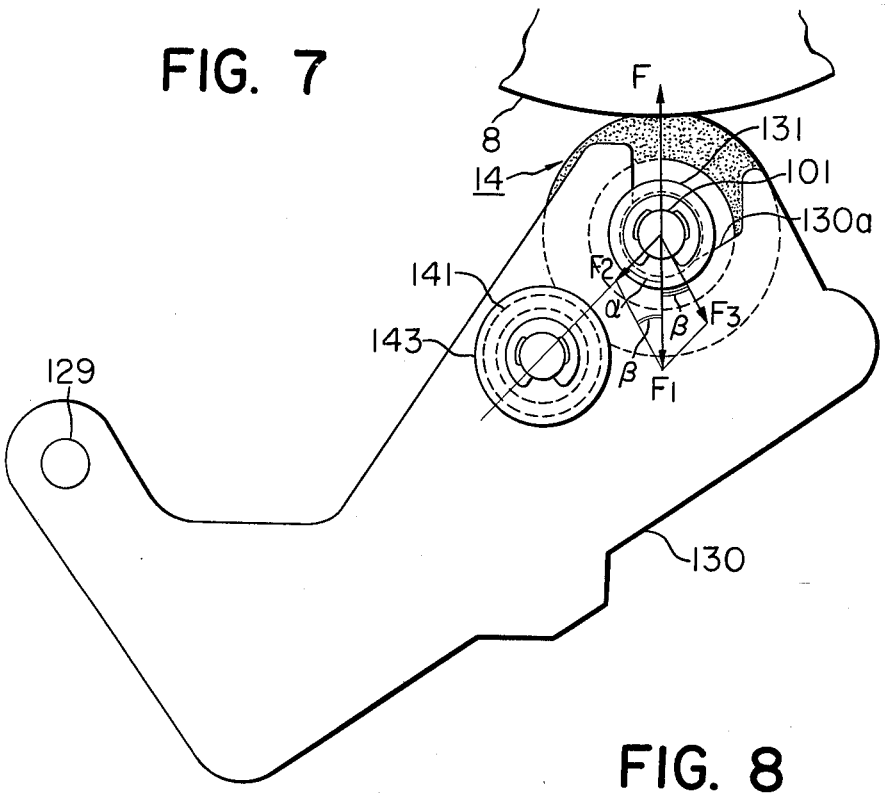
FIG. 7 is an illustration for explaining the forces applied to the developing roller shown in FIG. 3.

FIG. 7 shows contacting pressures practically applied to the developing roller during a developing operation. This is a view from the outside of the side plate 130. By the above described pick-up torque of the motor there is produced a contacting pressure F between developing roller 14 and drum 8 in view of the center of the rotation axis 101. $F_1$ is the reaction force to the contacting pressure F. The reaction force $F_1$ may be divided into components $F_2$ and $F_3$. The component force $F_2$ is directed to the center of the rotation axis of the refreshing roller 141 and the component force $F_3$ works in the direction normal to the groove 130*a*. As will be understood, the component force $F_2$ is nothing other than pressure contact force acting between the developing roller 14 and the refreshing roller 141 and the component force $F_3$ is the force to which the bottom surface of the groove 130*a* is subjected when the developing roller and the drum are in contact with each other under the force of F. Pressure contact force (contacting pressure) between the developing roller and the drum and that between the developing roller and the refreshing roller can be determined experimentally. When data of these pressure contact forces are once obtained, an optimum or ideal position of the developing roller relative to the drum and also to the refreshing roller for developing operation will be determined based upon the data. FIG. 7 illustrates the ideal positional relation among developing roller, drum and refreshing roller determined in such manner.

Grooves or notches 103*a*, 130*a* provided on the side plated 103, 130 have each a width equal to the outer diameter of the bearings 102, 131. The bearings 102, 131 are slide movable without any play in the grooves 103*a*, 130*a* respectively.

Let $\alpha$ denote the angle which the straight line binding the center of developing roller to the center of drum makes with the straight line binding the center of developing roller to the center of refreshing roller and $\beta$ the angle which the first mentioned straight line makes with the perpendicular drawn from the center of developing roller to groove 130*a*. Then, the relation between the resultant force $F_1$ and its component $F_2$ is represented by $$F_1 \sin\beta = F_2 \sin(\alpha+\beta)$$

$$F_2 = F_1 \sin\beta / \sin(\alpha+\beta)$$

It is recommendable that $\alpha$ and $\beta$ be obtained experimentally from the data of thickness, material, hardness etc. of the foam layer in the developing roller 14. For example, if a larger pressure contact force is desired between the developing roller and refreshing roller, this may be attained by using a smaller value of $\alpha$ or, when $\alpha$=constant, by using a value of $\beta$ near 90°. Therefore, when the positions of developing the roller and refreshing roller are fixed, the pressure contact force therebetween may be changed in a very simple manner only by changing the shape of the grooves or notches formed on the side plates 103 and 130. Even when the circle of the developing roller is deformed from a true circle, the ratio in pressure of $F_1$ and $F_2$ is kept unchanged in principle by $\alpha$ and $\beta$ determined in designing.

Pressure contact force between the developing roller and the drum may be changed in various ways such as by changing the position of pulley 184 or pulley 183, by changing the capacity of motor, or by changing the outer diameter of cord winding pulley 179. Among them, the method by changing of the outer diameter of the winding pulley 179 is preferable, because it is easy to carry out and it does not affect other parts of the apparatus so much.

Figure 8:
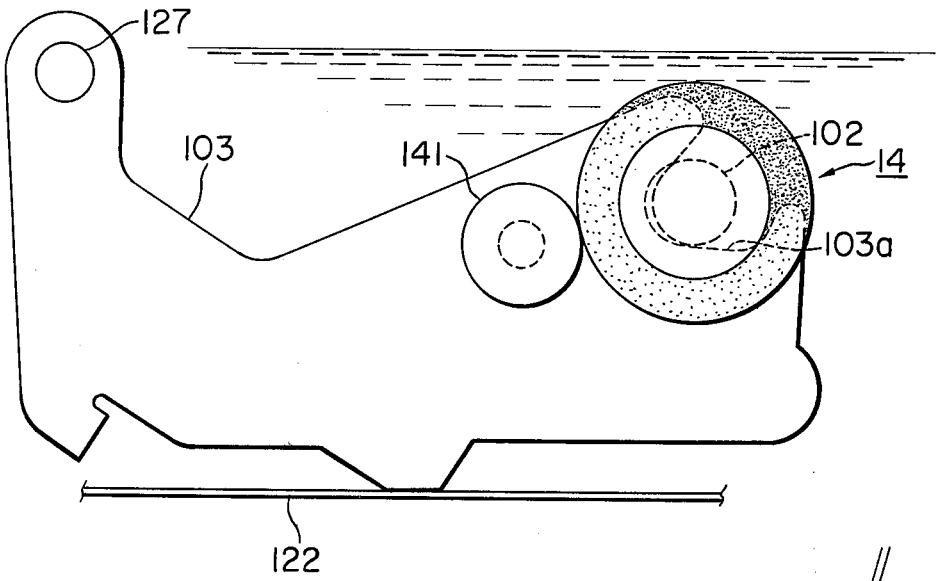
FIG. 8 shows the developing roller immersed in liquid developer.

FIG. 8 shows the developing roller immersed in the liquid developer. Since the developing roller is free from pressure contact with the drum, there is no external force acting between the developing roller and the refreshing roller excepting gravity. As will be seen from FIG. 8, in the immersed position of the developing apparatus, the groove 103*a* of the side plate 103 becomes almost parallel with the bottom surface of the container 122. In other words, the groove 103*a* is in horizontal in this position of the apparatus. Therefore, the force exerted by the gravity between the developing roller and the refreshing roller is extremely small. Because of absence of load on the foam layer, it can expand to restore itself to its original state. As the foam layer returns from the compressed state to its original uncompressed state, the developing roller moves rightwardly as view in the drawing of FIG. 8 so that a gap is produced between the bearing 102 and the groove 103*a* by a distance corresponding to the thickness of the foam layer previously compressed by the above mentioned contacting ppressure. In this position, the developing roller and the refreshing roller are in contact with each other without any substantial contacting pressure therebetween. The developing roller never suffers permanent deformation. The evaporation of liquid developer from the container is reduced to a minimum because the container is almost hermetically closed. Being immersed completely in the liquid developer during rest time, the developing roller can be started again at once for the next developing operation even after a long rest time and it works well always to produce a copy of high quality. For conventional apparatus there occurs such trouble that the operator erroneously forgets to disconnect the developing roller from the drum at the time of inspection or maintenance of the drum or the developing apparatus, which may cause some serious accident. For the apparatus according to the invention described above, such error can not occur at all. Exchange of developing roller may be carried out in a very simple manner by rotating the winding pulley by hand to lift the roller and removing it from the groove.

Figure 9A:
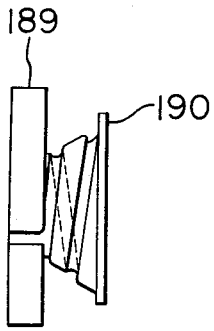
FIG. 9A shows another embodiment of a winding pulley useful in the developing apparatus shown in FIG. 3.
Figure 9B:
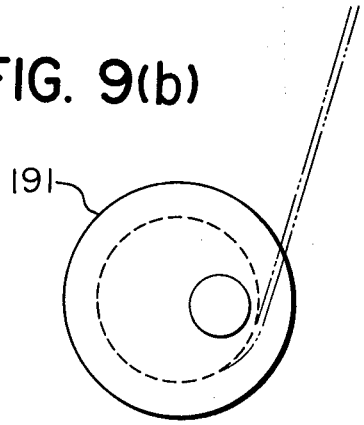
FIG. 9B shows another embodiment of the winding pulley.

FIGS. 9A and 9B shows a modification of the winding pulley shown in FIG. 6. The pulley 179 shown in FIG. 6 is so designed as to have uniform diameter along the center axis. Generally, it is desirable that the time required to move the developing roller from its lowered position (immersed position in liquid) to its lifted position (pressure contacting position with drum) should be as short as possible. Pressure contact force between the developing roller and the drum is one important factor determining the liquid squeezing effect during developing operation although the effect may vary depending upon other factors such as thickness, material and hardness of the foam layer of the developing roller. Therefore, a larger pressure contact force is required to attain a larger liquid squeezing effect during developing operation. The pulley shown in FIG. 9 is so designed as to satisfy the two requirements mentioned above at the same time.

The pulley 189 shown in FIG. 9A has a profile similar to a frustum of a cone and therefore the outer diameter of the pulley changes along the center axis thereof. On the conical surface of the pulley there is provided a spiral slot along which the wire code is wound up or off. At the area of larger diameter, the wire code is wound up on the pulley at a higher speed than that at the other area of smaller diameter. But, at the area of smaller diameter, a desired large pressure contact torque is obtained. When the wire code is being wound up on the area of larger diameter, the tension applied to the wire code is relatively low. However, this is sufficient to move the developing roller. When the developing is about to come into contact with the drum, the wire code is wound up on the area of smaller diameter so that a high tension is given to the wire code. In this manner, a large pressure contact force can be obtained between the developing roller and the drum. In FIG. 9A, a ring plate 190 functionally corresponds to the ring plate 188 shown in FIG. 6.

Pulley 191 shown in FIG. 9B resembles an eccentric cam. The pulley is shown in the position in which the developing roller and the drum are in pressure contact with each other. The pulley 191 pulls the wire cord with its area of smaller diameter and therefore tension exerting on the wire cord is high. Like the above described pulley 189, this pulley 191 can wind up the wire cord at a higher speed at the beginning of winding during which large tension is not required. At the end of winding, it can produce a large torque as desired.

As will be understood from the foregoing, the developing apparatus according to the invention has various advantages and features as described in the beginning part of the specification. According to the invention, advantageous features of three layer structure of developing roller comprising net, foam and core can be fully and completely utilized.

While the invention has been particularly shown and described with reference to preferred embodiments thereof, it will be understood that various modifications may be made therein without departing from the spirit and scope of the invention. For example, while the photosensitive medium in a form of drum has been shown, the present invention is applicable also to that in a form of belt without losing its effect.

What we claim is:

1. An electrophotographic developing apparatus comprising:

a developing roller contactable with a rotatable electrostatic latent image carrier for applying liquid developer thereto; and a refreshing roller contactable with said developing roller and rotatable at substantially the same speed and in the same direction as the electrostatic latent image carrier;

said developing roller being adapted to be interposed substantially between the electrostatic latent image carrier and said refreshing roller, and being adapted to be driven by the rotation of the latent image carrier and said refreshing roller during development of an electrostatic latent image carried on the electrostatic latent image carrier.

2. An electrophotographic developing apparatus as claimed in claim 1, wherein said developing roller comprises a core member, a foam layer of open cellular structure overlaid on said coremember and a net covering the outer surface of said foam layer.

3. An electrophotographic developing apparatus as claimed in claim 2, wherein said core member of said developing roller is electrically conductive.

4. An electrophotographic developing apparatus as claimed in claim 3, wherein said net of said developing roller is electrically conductive.

5. An electrophotographic said developing apparatus as claimed in claim 3, wherein said foam layer of developing roller is electrically conductive.

6. An electrophotographic developing apparatus as claimed in claim 4, wherein said apparatus includes means for applying a bias voltage to said net.

7. An electrophotographic developing apparatus as claimed in claim 5, wherein said apparatus includes means for applying a bias voltage to said foam layer.

8. An electrophotographic developing apparatus as claimed in claim 1, wherein an electrode is disposed in the vicinity of said developing roller to which electrode a bias voltage is applied.

9. An electrophotographic developing apparatus as claimed in claim 1, further comprising side plates for supporting thereon said refreshing roller, said side plates being notched to form grooves in which said developing roller is supported, wherein the degree of pressure contact between said developing roller and said refreshing roller is determined by the angle which the perpendicular drawn to the developing roller supporting surface of said groove from the center of said developing roller makes with the straight line binding the center of said developing roller to the center of the electrostatic latent image carrier.

10. An electrophotographic developing apparatus comprising:

a developing roller comprising an electrically conductive core member, a foam layer of open cellular structure overlaid on said core member and a net covering the outer surface of said foam layer;

a container containing therein liquid developer;

a carrier for carrying thereon an electrostatic latent image to be developed; and means for bringing the whole developing roller into a position in which said developing roller is immersed in the liquid developer.

11. An electrophotographic developing apparatus as claimed in claim 10, wherein said means for immersing the developing roller in the liquid developer comprises a motor of the type which produces a maximum torque at its output shaft when said output shaft is stopped while maintaining the supply of voltage to said motor; a pulley fixed to said output shaft of said motor; a wire cord one end of which is secured to said pulley; one or more intermediate pulleys rotatably mounted to guide said wire cord; and a mounting member to which the other end of said wire cord is fixed and which is pivotably movable about a pivot together with said developing roller.

12. An electrophotographic developing apparatus as claimed in claim 11, wherein said wire cord winding pulley is so designed that the area of said pulley used when said developing roller is lifted up from the liquid developer has a larger pulley diameter than the area used when said roller is contacted with said latent image carrier.

13. An electrophotographic developing apparatus as claimed in claim 10, wherein said apparatus further comprises means for removing both of the forces of forced pressure contacts between said carrier and said developing roller and between said developing roller and said refreshing roller.

14. An electrophotographic developing apparatus comprising:

developing means for applying liquid developer to a moving electrostatic latent image carrier, said developing means being movable in the directions toward and apart from a liquid developer containing part and in a direction other than the above to apply the liquid developer to said latent image carrier;

refreshing means provided for said developing means, said refreshing means being able to come into contact with said developing roller so as to drive said developing roller moving in the direction for applying liquid developer to said latent image carrier at a speed substantially equal to the moving speed of said carrier; and driving means for driving said refreshing means during a developing operation.

* * * * *